US006606473B1

(12) United States Patent
Wang et al.

(10) Patent No.: US 6,606,473 B1
(45) **Date of Patent: *Aug. 12, 2003**

(54) TONER CONTAINER FOR USE WITH A DEVELOPING DEVICE IN AN IMAGE FORMING APPARATUS

(75) Inventors: Jui-Chi Wang, Taichung (TW); Robin Hsu, Taichung (TW); Ya Li Huang, Taichung (TW); Kuan Tung Li, Yunlin (TW); Ren-Hao Liu, Taichung (TW); Shu Hui Wang, Taichung (TW); Xiao Hui Wang, Taichung (TW); Ting Hsuan Ko, Taichung (TW); Hui Wen Hsieh, Taichung (TW)

(73) Assignee: General Plastic Industrial Co., Ltd., Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/171,040

(22) Filed: Jun. 11, 2002

(30) Foreign Application Priority Data

Feb. 8, 2002 (CN) ..... 91201946 U

(51) Int. Cl.[7] ..... G03G 15/08
(52) U.S. Cl. ..... 399/258; 399/113; 399/260
(58) Field of Search ..... 399/258, 106, 399/109, 111, 113, 105, 259, 260, 262; 222/DIG. 1

(56) References Cited

U.S. PATENT DOCUMENTS

| | | | | | |
|---|---|---|---|---|---|
| 4,456,154 | A | * | 6/1984 | Herriman | 222/DIG. 1 |
| 4,615,364 | A | * | 10/1986 | Kawata | 222/DIG. 1 |
| 4,942,432 | A | * | 7/1990 | Mort et al. | 399/106 |
| 5,475,469 | A | * | 12/1995 | Okada et al. | 399/264 |
| 5,621,507 | A | * | 4/1997 | Nishimura et al. | 399/111 |
| 2003/0039484 | A1 | * | 2/2003 | Naito et al. | 399/113 |

FOREIGN PATENT DOCUMENTS

| | | | | | |
|---|---|---|---|---|---|
| JP | 5916975 | A | * | 9/1984 | G03G/15/08 |
| JP | 08179611 | A | * | 7/1996 | G03G/15/08 |

* cited by examiner

*Primary Examiner*—Susan S. Y. Lee
*Assistant Examiner*—Ryan Gleitz
(74) *Attorney, Agent, or Firm*—Merchant & Gould; Tim Tingkang Xia

(57) ABSTRACT

A toner container used with a developing device in an image forming apparatus is disclosed having a toner accommodating portion adapted for accommodating toner; a stirring member adapted for stirring toner in the toner accommodating portion, toner supplying openings for output of toner from the toner container to the developing device, a sliding cover adapted for closing/opening the toner supplying openings, and projections respectively protruded from the sliding cover and adapted for engaging into toner receiving openings of the developing device for enabling the toner container to be moved relative to the sliding cover and the developing device to close/open the toner supplying openings.

8 Claims, 4 Drawing Sheets

TONER CONTAINER FOR USE WITH A DEVELOPING DEVICE IN AN IMAGE FORMING APPARATUS

BACKGROUND OF THE INVENTION

1. Field of the Invention

The present invention relates to a toner container for use with a developing device in an image forming apparatus, for example, a laser printer and, more particularly, to such a toner container, which is equipped with a sliding cover adapted for closing/opening toner supply openings.

2. Description of the Related Art

A regular process cartridge for laser printer is generally comprised of an electrophotographic photosensitive member, developing means, charging means, cleaning means, and a toner container. When the toner of the toner container used up, the whole assembly of the process cartridge becomes useless and must be thrown away. It is not economic to throw the whole assembly of the process cartridge away after empty of the process cartridge. Further, the waste process cartridge may cause pollution to the environment if it is not well disposed of.

SUMMARY OF THE INVENTION

The present invention has been accomplished to eliminate the aforesaid drawbacks. In one aspect, the present invention relates to a toner container for use with a developing device in a laser printer, which enables the user to replace the toner container without throwing the whole assembly of the process cartridge away when the toner of the toner container is depleted. In order to make the toner container replaceable, the toner container is provided with movable means that can easily and freely be moved between two positions to close/open the toner passage. According to one aspect of the present invention, the toner container is used with a developing device in a laser printer, comprising a toner accommodating portion adapted for accommodating toner, a stirring member adapted for stirring the toner in the toner accommodating portion, toner supplying openings for output of the toner from the toner container to the developing device, a sliding cover adapted for closing/opening the toner supplying openings, and projections respectively protruded from the sliding cover and adapted for engaging into toner receiving openings of the developing device to enable the toner container to be moved relative to the sliding cover and the developing device to close/open the toner supplying openings.

DETAILED DESCRIPTION OF THE PREFERRED EMBODIMENT

Figure 1:
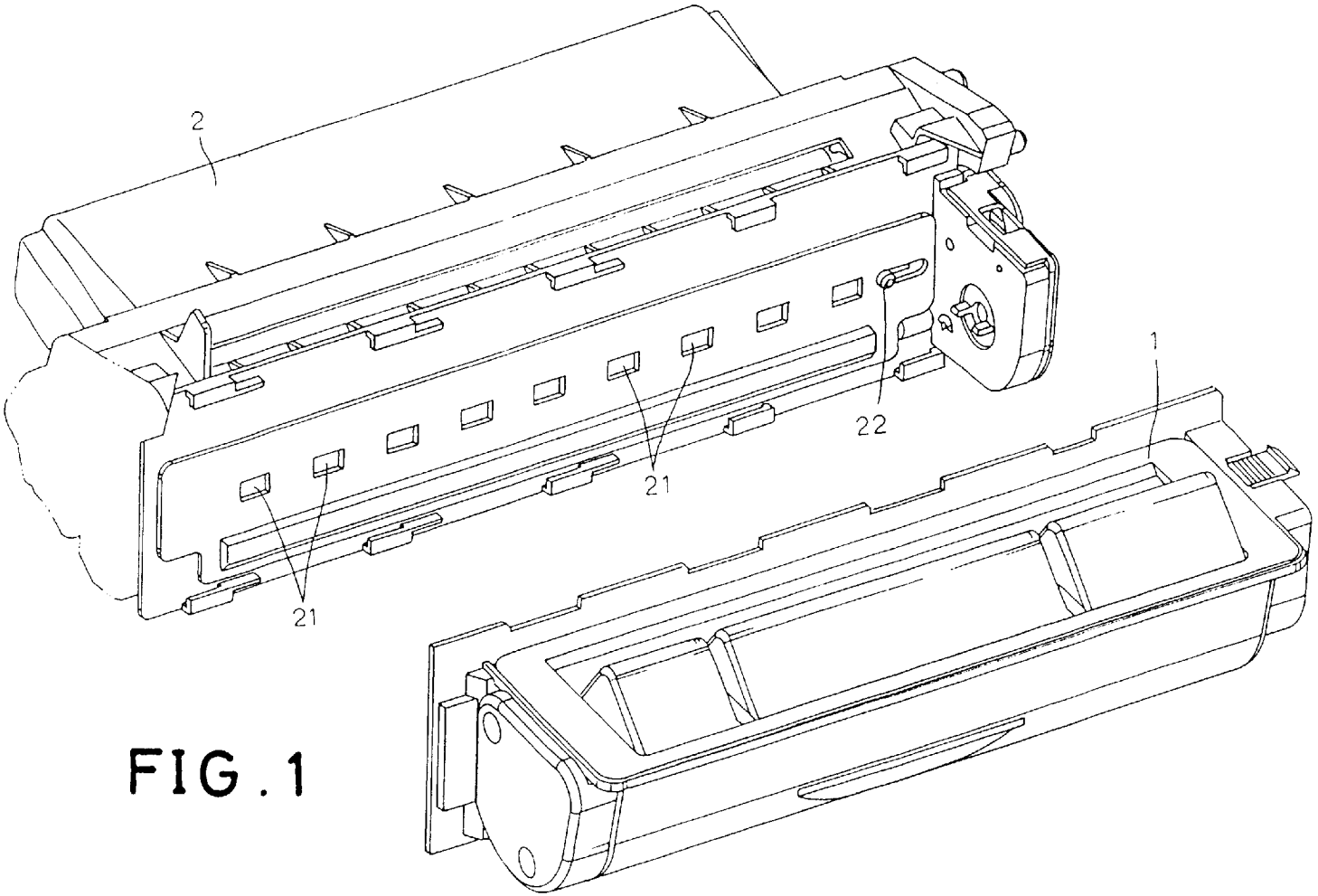
FIG. 1 is an exploded view of a toner container and a developing device according to the present invention.

Referring to FIG. 1, a toner container 1 is shown detachably mountable to a developing device 2.

Figure 3:
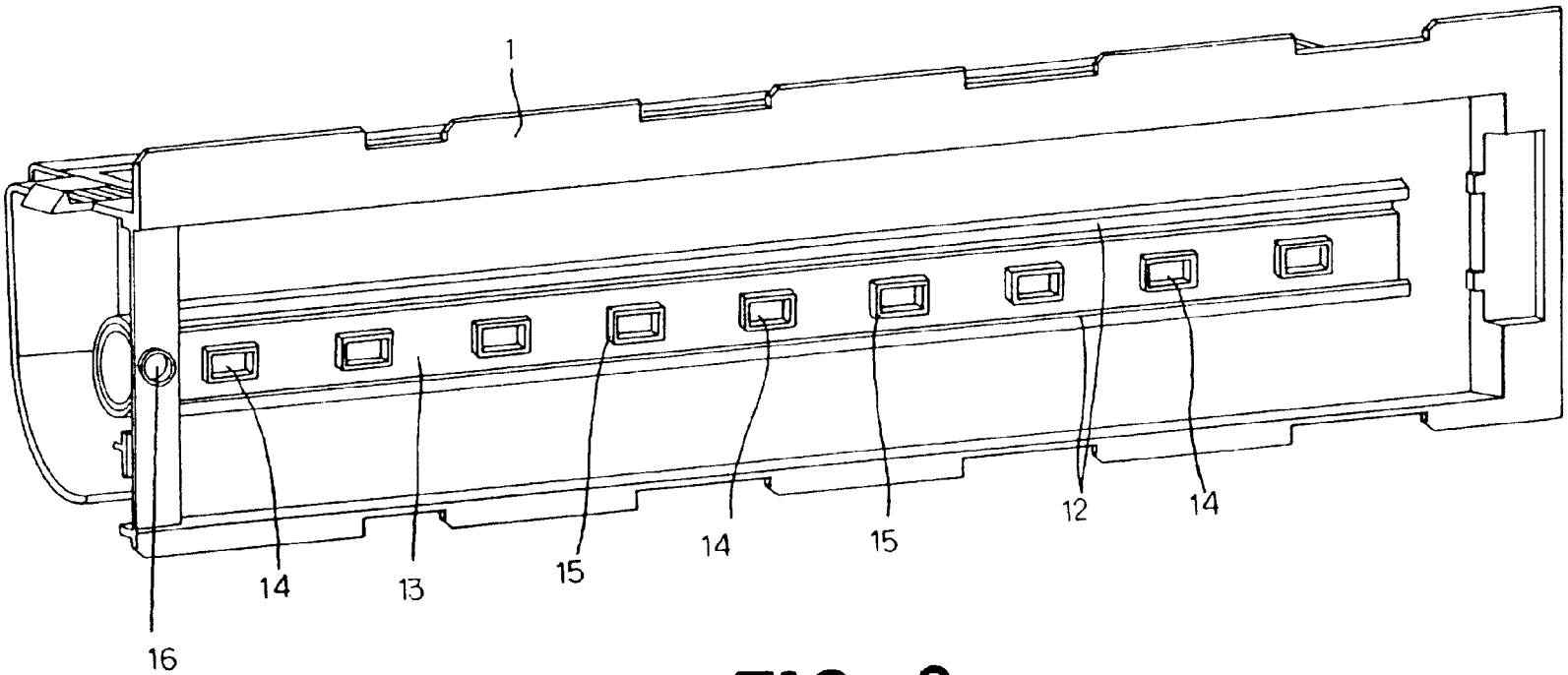
FIG. 3 is similar to FIG. 2 but showing the sliding cover moved to the close position.

Referring to FIG. 3 and FIG. 1 again, the toner container 1 comprises a plurality of toner supplying openings 11 arranged in a line in one side thereof, two elongated guide members 12 arranged in parallel at different elevations above and below the toner supplying openings 11, and a sliding cover 13 inserted in between the guide members 12 and moved to close/open the toner supplying openings 11. The sliding cover 13 comprises a plurality of openings 14 corresponding to the toner supplying openings 11.

Figure 2:
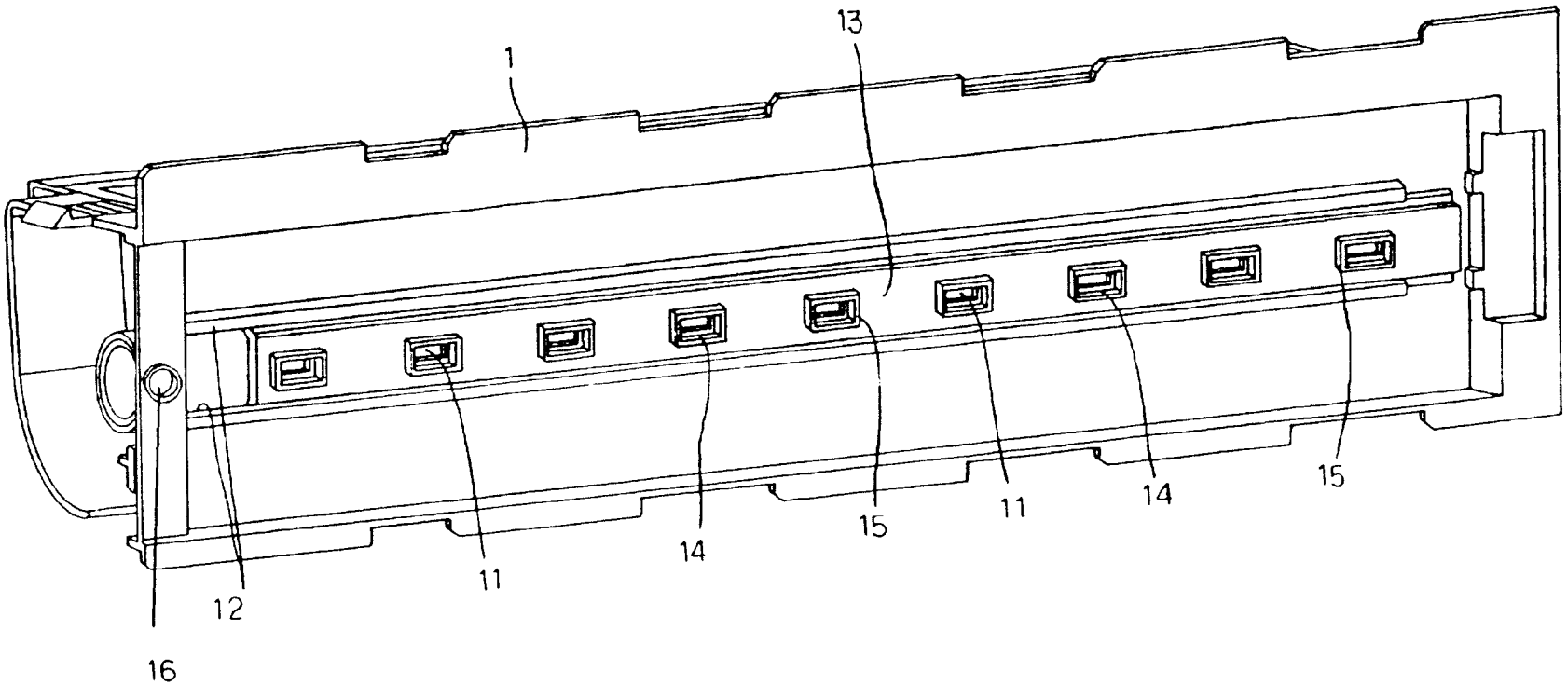
FIG. 2 is an elevational view of the toner container according to the present invention, showing the sliding cover moved to the open position.

Referring to FIG. 2, the toner container 1 further comprises projection means 15. According to the present preferred embodiment, the projection means 15 is comprised of a plurality of projections respectively protruded from the sliding cover 13 around each opening 14.

Referring to FIG. 1 again, the developing device 2 comprises a plurality of toner receiving openings 21, and a toner accommodating portion (not shown). Electrophotographic photosensitive means, developing means, charging means, and cleaning means are provided inside the toner accommodating portion of the developing device 2 (The internal arrangement of the developing device is of the known art and not within the scope of the present invention, no further detailed description is necessary). The developing device 2 further comprises recess means corresponding to the projections 15 of the sliding cover 13 of the toner container 1. According to the present preferred embodiment, the recess means is comprised of a plurality of toner receiving openings 21 adapted for receiving the projections 15 of the sliding cover 13 of the toner container 1 to guide toner from the toner container 1 into the toner accommodating portion of the developing device 2.

Figure 4:
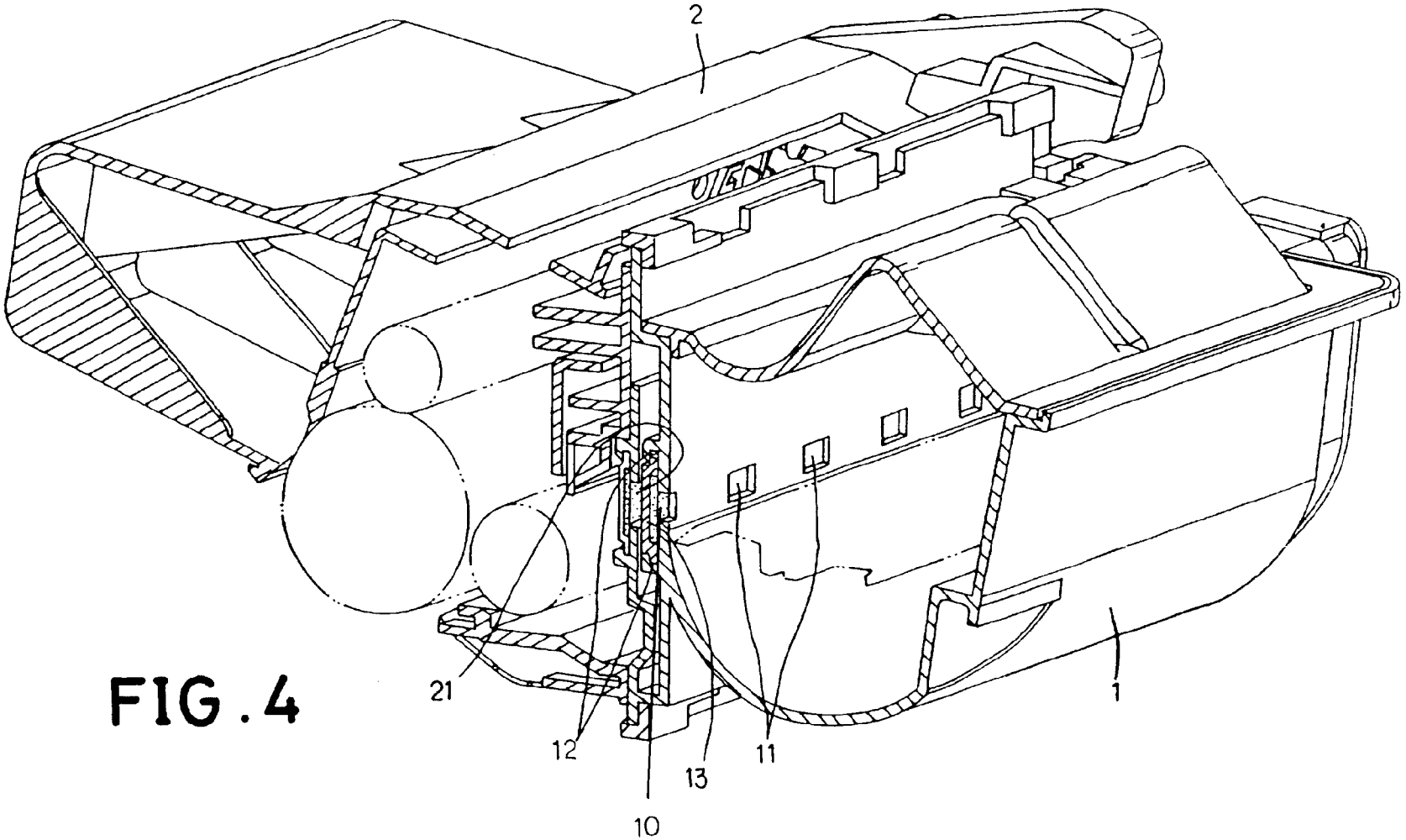
FIG. 4 is a sectional elevation showing the toner container and the developing device assembled.

Referring to FIG. 4 and FIG. 1 again, when the toner container 1 and the developing device 2 are coupled together and set in the open position, the toner container 1 and the developing device 2 are maintained closely attached to each other, keeping the projections 15 of the sliding cover 13 of the toner container 1 respectively engaged into the toner receiving openings 21 of the developing device 2. After installation in the laser printer (not shown), the sliding cover 13 is positively secured in position. When the toner container 1 is shifted sideways to be mounted on the developing device 2, the toner supplying openings 11 are respectively moved into alignment with the openings 14 of the sliding cover 13 and the toner receiving openings 21 of the developing device 2 to enable the toner to be delivered from the toner container 1 to the developing device 2 (see FIG. 2).

On the contrary, when the toner container 1 is shifted in the reverse direction to be dismounted from the developing device 2, the relative movement between the toner container 1 and the sliding cover 13 causes the sliding cover 13 to close the toner supplying openings 11 (see FIG. 3).

Referring to FIGS. 2 and 3 again, the toner container 1 further comprises a retaining hole 16 disposed in line with the toner supplying openings 11 at one side and adapted for receiving a projection rod 22 of the developing device 2 for controlling the operation of other switching means.

Referring to FIG. 4, a sponge lining 10 is installed in between the toner container 1 and the sliding cover 13 around the toner supplying openings 11 to prevent leakage of toner during toner supplying operation.

A prototype of toner container has been constructed with the features of FIGS. 1~4. The toner container functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A toner container for use with a developing device in an image forming apparatus, comprising:

a toner accommodating portion adapted for accommodating toner;

a stirring member adapted for stirring toner in said toner accommodating portion;

a plurality of toner supplying openings on a surface of the toner accommodating portion for output of toner from said toner accommodating portion to said developing device, wherein said toner supplying openings are formed substantially along a longitudinal axis of the toner accommodating portion;

a sliding cover adapted for closing/opening said plurality of toner supplying openings; and at least one projection extended from said sliding cover and adapted for fastening said developing device to enable said toner container to be moved relative to said sliding cover and said developing device along the longitudinal axis of the toner accommodating portion to close/open said toner supplying openings, wherein said sliding cover comprises a plurality of openings adapted for guiding toner from said at least one toner supplying opening to said developing device, said at least one projection includes a plurality of projections respectively protruded from said sliding cover around the openings of said cover and adapted for engaging into respective toner receiving holes of said developing device.

2. A toner container for use with a developing device in an image forming apparatus, comprising:

a toner accommodating portion adapted for accommodating toner;

a plurality of toner supplying openings formed on a surface of the toner accommodating portion along a longitudinal axis of the toner accommodating portion;

a sliding cover with at least one opening; and at least one projection protruding from the sliding cover and adapted for engaging the toner accommodating portion to the developing device such that when the toner accommodating portion is moved in a motion relative to the sliding cover and the developing device along the longitudinal axis of the toner accommodating portion, the sliding cover opens at least one of the plurality of toner supplying openings to allow toner from the toner accommodating portion to be delivered to the developing device, and when the toner accommodating portion is moved in a motion relative to the sliding cover and the developing device along the longitudinal axis of the toner accommodating portion in a reverse direction, the sliding cover closes the plurality of toner supplying openings, wherein the at least one projection is protruding from the sliding cover around the at least one opening of the sliding cover.

3. The toner container of claim 2, wherein the sliding cover further comprises additional openings, each opening being adapted for guiding toner from a corresponding toner supplying opening of the toner container to the developing device.

4. The toner container of claim 3, further comprising additional projections, each projection protruding from a corresponding opening of the sliding cover and being adapted for engaging the toner accommodating portion to the developing device.

5. The toner container of claim 4, wherein the developing device has a plurality of toner receiving openings on a side of the developing device adapted for receiving toner, and wherein each of the plurality of the projections protruding from the sliding cover is received into a corresponding toner receiving opening so as to engage the toner accommodating portion to the developing device.

6. A toner container for use with a developing device in an image forming apparatus, comprising:

a toner accommodating portion adapted for accommodating toner;

a plurality of toner supplying openings formed on a surface of the toner accommodating portion along a longitudinal axis of the toner accommodating portion;

a sliding cover with a plurality of openings, each being adapted for guiding toner from a corresponding toner supplying opening of the toner container to the developing device;

a plurality of projections, each protruding from the sliding cover around a corresponding opening of the sliding cover and adapted for engaging the toner accommodating portion to the developing device, wherein when the toner accommodating portion is moved in a motion relative to the sliding cover and the developing device along the longitudinal axis of the toner accommodating portion, the sliding cover opens the plurality of toner supplying openings to allow toner from the toner accommodating portion to be delivered to the developing device, and when the toner accommodating portion is moved in a relative motion to the sliding cover and the developing device along the longitudinal axis of the toner accommodating portion in a reverse direction, the sliding cover closes the plurality of toner supplying openings.

7. The toner container of claim 6, wherein the developing device has a plurality of toner receiving openings on a side of the developing device adapted for receiving toner, and wherein each of the plurality of the projections protruding from the sliding cover is received into a corresponding toner receiving opening so as to engage the toner accommodating portion to the developing device.

8. The toner container of claim 6, further comprising a stirring member adapted for stirring toner in the toner accommodating portion.

* * * * *